US007688212B2

(12) United States Patent
Farley

(10) Patent No.: US 7,688,212 B2
(45) Date of Patent: Mar. 30, 2010

(54) METHOD AND APPARATUS FOR PROVIDING OCCUPANCY INFORMATION IN A FIRE ALARM SYSTEM

(75) Inventor: Daniel G. Farley, Westminster, MA (US)

(73) Assignee: SimplexGrinnell LP, Westminster, MA (US)

( * ) Notice: Subject to any disclaimer, the term of this patent is extended or adjusted under 35 U.S.C. 154(b) by 368 days.

(21) Appl. No.: 11/881,312

(22) Filed: Jul. 26, 2007

(65) Prior Publication Data

US 2009/0027225 A1 Jan. 29, 2009

(51) Int. Cl.

| | |
|---|---|
| ***G08B 23/00*** | (2006.01) |
| ***G08B 5/22*** | (2006.01) |
| ***G08B 7/00*** | (2006.01) |

(52) U.S. Cl. ..... 340/573.1; 340/825.49; 116/4

(58) Field of Classification Search ..... 340/573.1, 340/577, 3.1, 825.19, 825.36, 7.25, 7.27, 340/825.49, 286.02, 286.05, 539.13, 539.22, 340/539.26; 116/4–6, 206, 207

See application file for complete search history.

(56) References Cited

U.S. PATENT DOCUMENTS

| | | | | |
|---|---|---|---|---|
| 5,267,180 | A * | 11/1993 | Okayama | 702/33 |
| 5,465,115 | A | 11/1995 | Conrad et al. | |
| 6,208,905 | B1 | 3/2001 | Giddings et al. | |
| 6,712,269 | B1 | 3/2004 | Watkins | |
| 7,182,174 | B2 | 2/2007 | Parrini et al. | |
| 7,298,259 | B2 * | 11/2007 | Moriwaki | 340/539.22 |
| 7,466,224 | B2 * | 12/2008 | Ward et al. | 340/522 |
| 2005/0219048 | A1 * | 10/2005 | Kimmel et al. | 340/511 |
| 2007/0176770 | A1 * | 8/2007 | Shrode | 340/539.13 |
| 2008/0067244 | A1 | 3/2008 | Marks | |

FOREIGN PATENT DOCUMENTS

JP 11089962 A * 9/1997

* cited by examiner

*Primary Examiner*—Jennifer Mehmood
(74) *Attorney, Agent, or Firm*—The Small Patent Law Group LLP

(57) ABSTRACT

A method is provided for presenting occupancy information in a fire alarm system. The method includes obtaining event data indicative of an emergency event within a zone of a premises, obtaining count information indicative of a number of individuals within the zone of the premises, and displaying the event data and the count information for the zone simultaneously.

21 Claims, 10 Drawing Sheets

506

Counting Sensor / Zone Association Table

| Sensors | Zones |
|---|---|
| $14_1$ | $Z_1$ |
| $14_2$<br>$14_3$ | $Z_2$ |
| $14_4$<br>$14_5$<br>$14_6$ | $Z_3$ |
| $14_7$ | $Z_4$ |
| $14_8$ | $Z_5$ |
| $14_P$ | $Z_M$ |

512

508 510

600

Event to Individual Tracking Table 601

| Zone | Emergency Event | | | Count Information | | | |
|---|---|---|---|---|---|---|---|
| | Smoke | Temp | Water | Current Count | Prior Count | Change Indicator | Count Change |
| $Z_1$ - Floor 1 | ✓ | 300°F | | 21 | 23 | ↓ | -2 |
| $Z_2$ - Floor 2 | | | | | | | |
| $Z_3$ - Stairwell | | | | | | | |
| $Z_4$ - Restaurant | | | | | | | |
| $Z_5$ - Law Office | | | | | | | |
| $Z_M$ - Maintenance | | | | | | | |

608

602 604 606

FIG. 6

Event Detection / Zone Association Table

| Detectors | Zones |
|---|---|
| $16_1$ | $Z_1$ |
| $16_2$ | $Z_2$ |
| $16_3$<br>$16_4$ | $Z_3$ |
| $16_5$ | $Z_4$ |
| $16_6$<br>$16_7$<br>$16_8$ | $Z_5$ |
| $16_N$ | $Z_M$ |

712

708 710

METHOD AND APPARATUS FOR PROVIDING OCCUPANCY INFORMATION IN A FIRE ALARM SYSTEM

BACKGROUND OF THE INVENTION

The invention relates generally to fire alarm systems, and, more particularly, to providing occupancy information in a fire alarm system.

Many commercial and residential buildings and other premises include a fire alarm system that monitors the different areas or zones of the premises for the presence of fire and other emergency events. The fire alarm system may generate an alarm when a fire and/or other emergency event has been detected to indicate to security personnel of the premises the location within the premises in which the fire and/or other emergency event has been detected. The fire alarm system may also request dispatch of a fire department and/or other emergency response services, such as, ambulance services and/the like, to the premises for help responding to the fire and/or other emergency event.

Whether by the fire alarm system and/or the security personnel, the fire department and other emergency response service(s) may sometimes be provided with the location of the fire and/or other emergency event within the premises. Accordingly, the fire department and other emergency response service(s) can immediately begin to respond to the fire and/or other emergency event upon arrival at the premises. However, the fire department and other emergency response service(s) are typically not provided with any information that indicates where different individuals are located within the premises, for example in relation to the fire and/or other emergency event. The fire department and other emergency response service(s) may therefore be less capable of assisting and/or protecting the individuals within the premises. For example, fire department and other emergency response service(s) may therefore be less capable of directing individuals away from the fire or other emergency event, evacuating the individuals, and/or providing medial assistance to the individuals. Moreover, searching for where individuals are located within the premises may waste time and/or resources, for example individual firefighters, equipment, and/or other emergency workers, that may otherwise be used to respond to the fire and/or other emergency event.

There is a need to provide fire departments and other emergency response services with information during a fire and/or other emergency event about where individuals are located within a premises.

BRIEF DESCRIPTION OF THE INVENTION

In one embodiment, a method is provided for presenting occupancy information in a fire alarm system. The method includes obtaining event data indicative of an emergency event within a zone of a premises, obtaining count information indicative of a number of individuals within the zone of the premises, and displaying the event data and the count information for the zone simultaneously.

In another embodiment, a method is provided for monitoring individuals within a premises. The method includes obtaining sensor data, accessing a database to identify a zone within the premises that the sensor is associated with, accessing a record within the database or another database, the record corresponding to the identified zone that the sensor is associated with, and updating the corresponding record based on the obtained sensor data.

In another embodiment, a method is provided for monitoring individuals within a premises with respect to an occupancy threshold for the premises or at least one zone of the premises. The method includes obtaining sensor data associated with a number of individuals within the premises or the at least one zone of the premises, and comparing the obtained sensor data with information associated with the occupancy threshold for the premises or the at least one zone of the premises.

In another embodiment, a fire alarm system is provided for a premises. The fire alarm system includes at least one controller and a sensor operatively connected to the controller. The sensor is configured to sense count information indicative of a number of individuals within a zone of the premises. The fire alarm system also includes a detector operatively connected to the controller. The detector is configured to detect event data indicative of an emergency event within the zone of the premises. A user interface is operatively connected to the controller. The user interface is configured to display the event data and the count information for the zone simultaneously.

BRIEF DESCRIPTION OF THE DRAWINGS

FIG. 6 is an exemplary embodiment of user interface screen illustrating an event to individual tracking table.

DETAILED DESCRIPTION OF THE INVENTION

Figure 1:
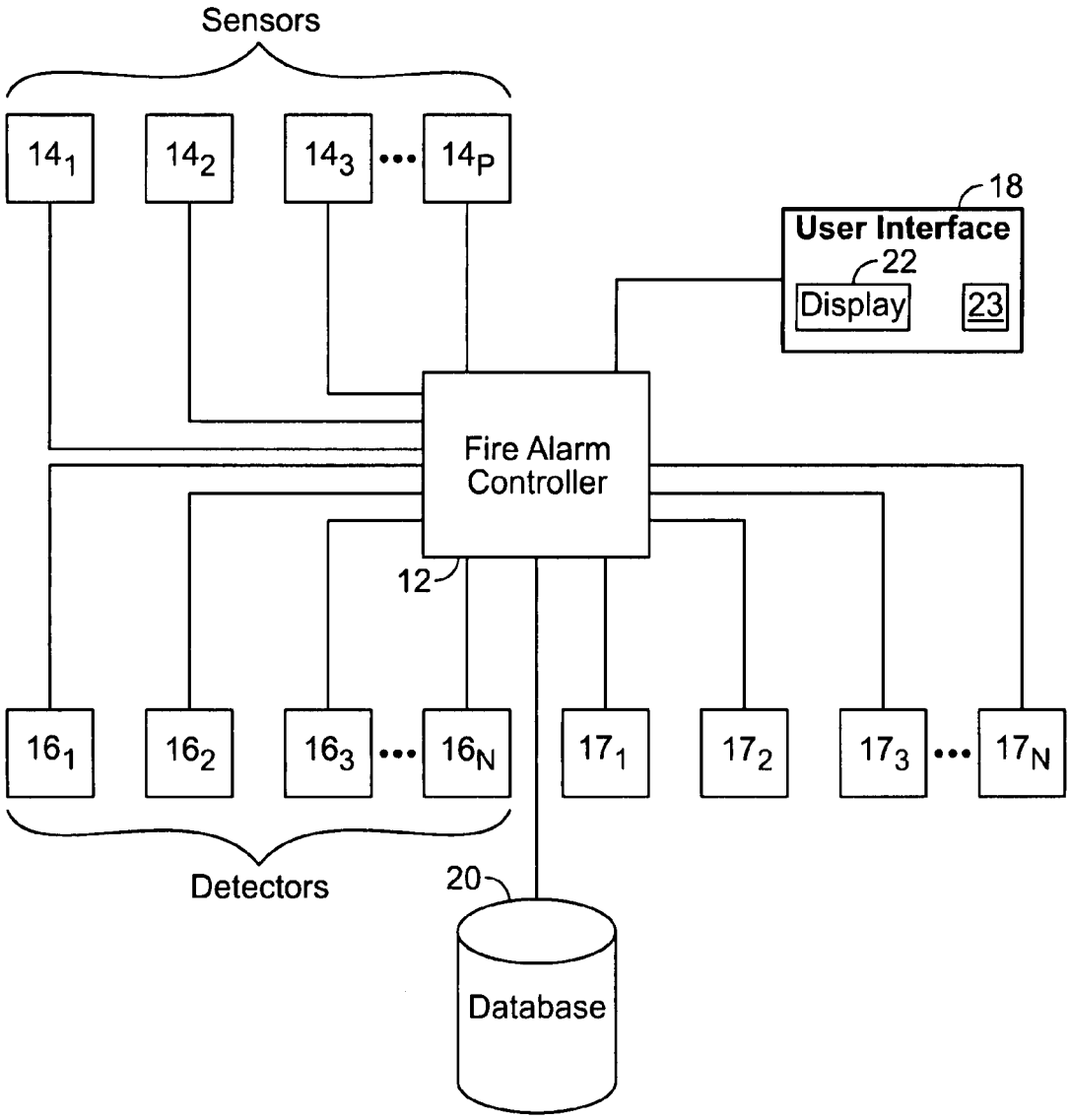
FIG. 1 is a block diagram of an exemplary embodiment of a fire alarm system for a premises.

FIG. 1 is a block diagram of an exemplary embodiment of a fire alarm system 10. As will be described below, the fire alarm system 10 includes components for monitoring individuals within a premises and for presenting occupancy information of the premises to a user. The fire alarm system 10 includes a fire alarm controller 12, a plurality of sensors 14 operatively connected to the fire alarm controller 12, a plurality of detectors 16 operatively connected to the fire alarm controller 12, and a plurality of notification appliances 17 operatively connected to the fire alarm controller 12. The fire alarm system 10 also includes a user interface 18 operatively connected to the fire alarm controller 12 and a database 20 operatively connected to the fire alarm controller 12. Optionally, the user interface 18 may include one or more notification appliances 23 for notifying a user about detected emergency event(s), as will be described below. As used herein, the term "premises" is intended to mean any building, structure, outdoor area (such as, but not limited to, a campus, a sporting facility, a strip mall, a park, a parking lot, a parking garage, and/or the like), and/or the like. As used herein, the term "individual" is intended to mean any living animal, such as, but not limited to, a human, a pet, another animal, and/or the like.

The detectors 16 are arranged throughout the premises to detect emergency events in different areas, or zones, of the premises. The zones may each be any portion of the premises, such as, but not limited to, an entire floor of the premises, a portion of a floor of the premises, a group of floors of the premises, an elevator of the premises, a stairwell of the premises, an escalator of the premises, a group of elevator(s), stairwell(s), and/or escalators of the premises, an entrance to the premises, an exit from the premises, a group of exit(s) and/or entrance(s) of the premises, a single room of the premises, a group of rooms of the premises, a general area of the premises, an entity within the premises (such as, but not limited to, a restaurant, another business, a residence, and/or the like), and/or the like. The premises may have any number of detectors 16 for detection of emergency e vents within any number of zones of the premises. FIG. 1 illustrates detectors $\mathbf{16}_1$-$\mathbf{16}_N$. Each zone of the premises may have one or more detectors 16 associated with the zone to detect one or more different types of emergency events. The detectors 16 may each be physically located anywhere within the zone with which the detector 16 is associated or alternatively may be located in a location that is not within the zone with which the detector 16 is associated but enables the detector 16 to detect one or more different types of emergency events within the zone. The detectors 16 detect any suitable type(s) of emergency events within the premises, such as, but not limited to, emergency events relating to fire (such as, but not limited to, a temperature within the zone the detector 16 is associated with, when a temperature within the zone the detector 16 is associated with is above a dynamic or predetermined threshold, the presence of smoke, water, and/or flame within the zone the detector 16 is associated with, and/or the like), a loss of electrical power within the zone the detector 16 is associated with, the presence of toxic gas within the zone the detector 16 is associated with, activation of a medical emergency alert button and/or a duress button within the zone the detector 16 is associated within, and/or the like. Each detector 16 may be any suitable type of detector that enables the detector 16 to detect one or more different emergency events.

The sensors 14 are arranged throughout the premises to obtain count information relating to a number of individuals within the zones of the premises. The premises may have any number of sensors 14 for obtaining count information about any number of zones of the premises. FIG. 1 illustrates sensors $\mathbf{14}_1$-$\mathbf{14}_P$. Each zone of the premises may have one or more sensors 14 associated with the zone to obtain the count information associated with the zone. The sensors 14 may each be physically located anywhere within the zone with which the sensor 14 is located or alternatively may be located in a location that is not within the zone with which the sensor 14 is associated but enables the sensor 14 to obtain the count information associated with the zone. The count information obtained by the sensors 14 may be any suitable type of count information, such as, but not limited to, a current count of a number of individuals within the zone that the sensor 14 is associated with, a change of the number of individuals within the zone that the sensor 14 is associated with, a number of individuals that have entered and/or exited the zone the sensor 14 is associated with over an amount of time, and/or the like. Each sensor 14 may be any suitable type of sensor that enables the sensor 14 to obtain count information. For example, the sensors 14 may be threshold sensors located at the entrances and exits of each zone to count the number of individuals entering and exiting the zone. Another example of the sensors 14 includes video analytic systems that analyze video images of the zones to determine the number of individuals within the zone and/or the number of individuals entering and exiting the zone. Still other examples of the sensors 14 for determining the number of individuals within the zones and/or the number of individuals entering and exiting the zones include proximity sensors located within the zones, electrical or other components (such as, but not limited to, finger print scanners, retina scanners, other biometric scanners, radio frequency identification (RFID) tags carried by individuals and RFID scanners located in the zones for detecting the RFID tags, and/or the like) that communicate with, or are a component of, an access control system of the premises that tracks and controls access of individuals to different zones within the premises, and/or the like.

The notification appliances 17 are arranged throughout the premises to notify individuals about detected emergency event(s) within zones of the premises. The premises may have any number of notification appliances 17 for notifying individuals within the premises about detected emergency events within any number of zones of the premises. FIG. 1 illustrates notification appliances $\mathbf{17}_1$-$\mathbf{17}_N$. Each zone of the premises may have one or more notification appliances 17 each located anywhere within the zone to notify individuals within the zone about one or more detected emergency events within the zone and/or within one or more other zones of the premises. The notification appliances 17 may each be any suitable type of notification appliance that enables the notification appliance 17 to notify individuals about detected emergency event(s), such as, but not limited to, audio appliances, visual appliances, and/or the like. Audio appliances may include, but are not limited to, audio alarms that emit noise but do not give specific instructions; audio appliances may also include, but are not limited to, audio alarms that provide audio messages which give instruction to individuals relating to the detected emergency event(s), such as, but not limited to, evacuation routes from the premises and/or a zone, instructing the individual(s) to remain where the individual is and wait for assistance, a description of the detected emergency event(s), and/or the like. Visual appliances may include, but are not limited to, visual alarms that do not give specific instructions (such as, but not limited to, non-flashing, strobing, or blinking light of any color, strobe lights of any color, flashing and/or blinking lights of any color, and/or the like); visual appliances may also include visual alarms that provide visual messages (such as, but not limited to, textual messages, graphical messages, pictorial messages, and/or the like) that give instruction to individuals relating to the detected emergency event(s), such as, but not limited to, evacuation routes from the premises and/or a zone, instructing the individual(s) to remain where the individual is and wait for assistance, a description of the detected emergency event(s), and/or the like.

The notification appliance(s) 23 may be any suitable type of notification appliance that enables the notification appliance 23 to notify a user about detected emergency event(s), such as, but not limited to, audio appliances, visual appliances, and/or the like. Audio appliances may include, but are not limited to, audio alarms that emit noise but do not give specific instructions; audio appliances may also include, but are not limited to audio alarms that provide audio messages which give instruction to a user relating to the detected emergency event(s), such as, but not limited to, evacuation routes from the premises and/or a zone, a severity of the detected emergency event(s), and/or the like. Visual appliances may include, but are not limited to, visual alarms that do not give specific instructions (such as, but not limited to, non-flashing, strobing, or blinking light of any color, strobe lights of any color, flashing and/or blinking lights of any color, and/or the like); visual appliances may also include, but are not limited to, visual alarms that provide visual messages (such as, but not limited to, textual messages, graphical messages, pictorial messages, and/or the like) which give instruction to a user relating to the detected emergency event(s), such as, but not limited to, evacuation routes from the premises and/or a zone, a severity of the detected emergency event(s), and/or the like.

The fire alarm controller 12 receives the emergency events detected by the detectors 16 and the count information obtained by the sensors 14. The fire alarm controller 12 accesses the database to 20 to store the detected emergency events and the count information in the database 20. Using the user interface 18, the fire alarm controller 12 displays the detected emergency events and the count information for one or more zones together, or "co-displays" the detected emergency event(s) and the count information. The co-displayed detected emergency event(s) and count information are identified with the corresponding zone(s) to indicate to the user both where the emergency event has occurred within the premises, i.e., which zone(s), and how many individuals are within the zone(s) wherein the emergency event has been detected. In some embodiments, the detected emergency event(s) and the count information for the zone(s) are co-displayed simultaneously such that the user can immediately identify the count information of the zone(s) wherein an emergency event has been detected. The count information displayed to the user may also include a change indicator that indicates a change in the number of individuals within the zone(s) having a detected emergency event(s) as compared to a previous count. The detected emergency event(s) and the count information may be co-displayed in any format, such as, but not limited to, textually and/or graphically. The change indicator may be any suitable symbol or other indication.

Co-displaying the detected emergency event(s) and the count information may help the user, for example a firefighter, a first responder emergency worker, another emergency worker, a security guard of the premises, and/or the like, make decisions on how to control and/or respond to the emergency event(s), and/or to protect individuals within the premises. In addition or alternative to the user, the fire alarm controller 12 may make decisions on how to control and/or respond to the emergency event, and/or to protect individuals within the premises, using the detected emergency event(s) and the count information. The change indicator may help the user understand the movement of individuals into and out of the zone(s) having a detected emergency event(s). The change indicator and/or other count information for a plurality of zones, only some or all of which may have a detected emergency event(s), may be displayed together to help the user understand movement of individuals within the premises overall and/or between zones having a detected emergency event(s) and/or adjacent zones.

Examples of controlling and/or responding to the emergency event to protect individuals within the premises, whether by the user and/or by the fire alarm controller, include, but are not limited to, activating one or more of the notification appliances 17, changing one or more audio and/or visual messages of one or more of the notification appliances 17, updating one or more evacuation routes from the premises or one or more evacuation routes from one or more zones of the premises to avoid congestion, and/or the like. For example, the shortest evacuation route may be the fastest when the number of individuals within one or more zones is below a threshold, while it may be faster to evacuate individuals along a longer path that can accommodate more individuals (e.g., a longer path having wider hallways) when the number of individuals within the one or more zones is above a threshold.

The fire alarm controller 12 may co-display the count information and the detected emergency event(s) using count information and/or a detected emergency event(s) received directly from the sensors 14 and the detectors 16, respectively. Alternatively, the fire alarm controller 12 may access the database 20 to obtain count information and/or a detected emergency event(s) that is stored on the database 20 for co-display on the user interface 18. Moreover, the fire alarm controller 12 may co-display count information and a detected emergency event(s) using a combination of data received directly from the sensors 14 and/or the detectors 16 and data stored on the database 20. The database 20 may store identification of the zone(s) of the premises that each detector 16 and/or each sensor 14 is associated with such that the detected emergency events and the count information co-displayed to the user may be identified with the corresponding zone(s). In addition or alternative, the fire alarm controller 12 may receive an identifier directly from the sensor 14 and/or the detector 16 that identifies which zone(s) the sensor 14 and/or the detector 16 is associated with.

The user interface 18 may include any number of displays 22 for co-displaying the detected emergency events and the count information. In the exemplary embodiment of FIG. 1, the user interface 18 includes only one display 22 that displays both the count information and the detected emergency event(s). Alternatively, the user interface 18 may include any number of displays 22 for co-displaying the count information and the detected emergency event(s), for example a display 22 that displays the count information and another display 22 that displays the detected emergency event(s).

Although only one database 20 is shown in FIG. 1, the fire alarm system 10 may have any number of databases 20 for storing the count information and the detected emergency events. For example, the fire alarm system 10 may include a database 20 for storing the count information and another database 20 for storing the detected emergency events. The database 20 that stores the count information may also store information that identifies which zone each sensor 14 is associated with. Likewise, the database 20 that stores the detected events may also store information that identifies which zone each detector 16 is associated with. Alternatively, the fire alarm system 10 may include one or more other databases 20 for storing information that identifies which zone each sensor 14 and each detector 16 is associated with.

Figure 2:
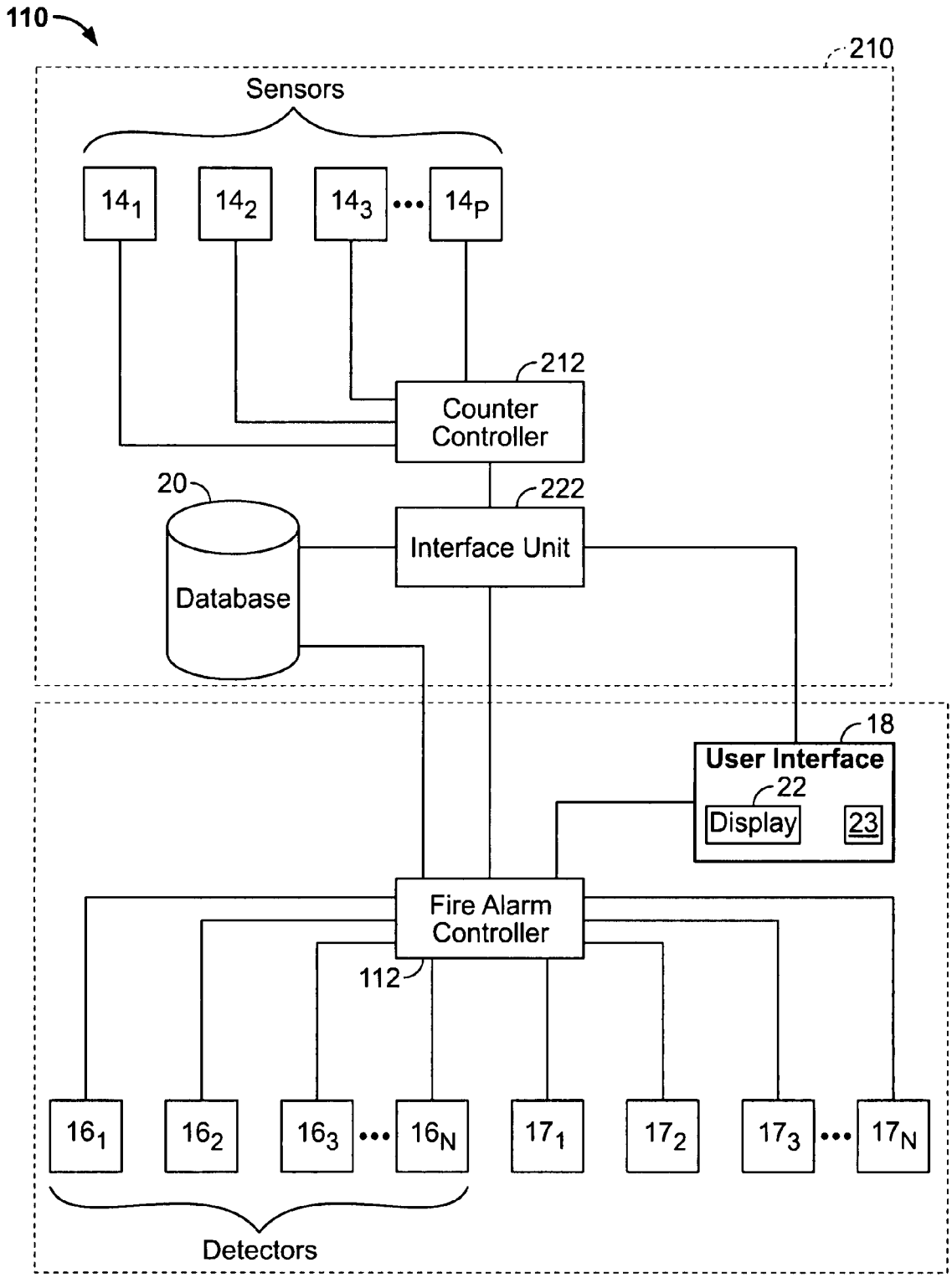
FIG. 2 is a block diagram of an exemplary alternative embodiment of a fire alarm system.

FIG. 2 is a block diagram of an exemplary alternative embodiment of a fire alarm system 110. The fire alarm system 110 includes a fire alarm controller 112, a plurality of the detectors 16 operatively connected to the fire alarm controller 112, the user interface 18 operatively connected to the fire alarm controller 112, a plurality of the notification appliances 17 operatively connected to the fire alarm controller 112, and a sub-system 210 for monitoring individuals within the premises and for presenting occupancy information of the premises to a user. The sub-system 210 includes a counter controller 212, a plurality of the sensors 14 operatively connected to the counter controller 212, an interface unit 222 operatively connected to both the fire alarm controller 112 and the counter controller 212, and the database 20, which is operatively connected to the interface unit 222. Optionally, the interface unit 222 is operatively connected to the user interface 18. The database may optionally be operatively connected to the fire alarm controller 112.

The fire alarm controller 112 receives the emergency events detected by the detectors 16 and the counter controller 212 receives the count information obtained by the sensors 14. The interface unit 222 receives the count information obtained by the sensors 14 from the counter controller 212. The interface unit 222 accesses the database 20 to store the count information in the database 20. In some embodiments, the interface unit 222 also receives the emergency events detected by the detectors 16 from the fire alarm controller 112 and accesses the database 20 to store the detected emergency events in the database 20. Alternatively, the fire alarm controller 112 accesses the database 20 to store the detected emergency events in the database 20.

The interface unit 222 and the fire alarm controller 112 may communicate with each other to achieve the co-display of the count information and the detected emergency event(s). Using the user interface 18, the interface unit 222 may co-display the count information and the detected emergency events for one or more zones, the fire alarm controller 112 may co-display the count information and the detected emergency events for one or more zones, or the interface unit 222 and the fire alarm controller 112 work together to co-display the count information and the detected emergency event(s). Specifically, in some embodiments the interface unit 222 may communicate with the user interface 18 to display the count information and the fire alarm controller 112 may communicate with the user interface 18 to display the detected emergency event(s).

The interface unit 222 and/or the fire alarm controller 112 may co-display the count information and the detected emergency event(s) using count information and/or a detected emergency event(s) received directly from the sensors 14 and the detectors 16, respectively. Alternatively, the interface unit 222 and/or the fire alarm controller 112 may access the database 20 to obtain count information and/or a detected emergency event(s) that is stored on the database 20 for co-display on the user interface 18. Moreover, the interface unit 222 and/or the fire alarm controller 112 may co-display count information and a detected emergency event(s) using a combination of data received directly from the sensors 14 and/or the detectors 16 and data stored on the database 20. The database 20 may store identification of the zone(s) of the premises that each detector 16 and/or each sensor 14 is associated with such that the detected emergency events and the count information co-displayed to the user may be identified with the corresponding zone(s). In addition or alternative, the counter controller 212 and/or the fire alarm controller 112 may receive an identifier directly from the sensor 14 and/or the detector 16 that identifies which zone(s) the sensor 14 and/or the detector 16 is associated with.

Although only one database 20 is shown in FIG. 2, the fire alarm system 110 overall and the sub-system 210 individually may each have any number of databases 20 for storing the count information and the detected emergency events. For example, in addition to the database 20 of the sub-system 210, the fire alarm system 110 may another database 20 that is not part of the sub-system 210 for storing the detected emergency events, wherein the database 20 of the sub-system 210 stores the count information. The database 20 that stores the count information may also store information that identifies which zone each sensor 14 is associated with. Likewise, the database 20 that stores the detected events may also store information that identifies which zone each detector 16 is associated with. Alternatively, the fire alarm system 110 and/or the sub-system 210 may include one or more other databases 20 for storing information that identifies which zone each sensor 14 and each detector 16 is associated with.

Figure 3:
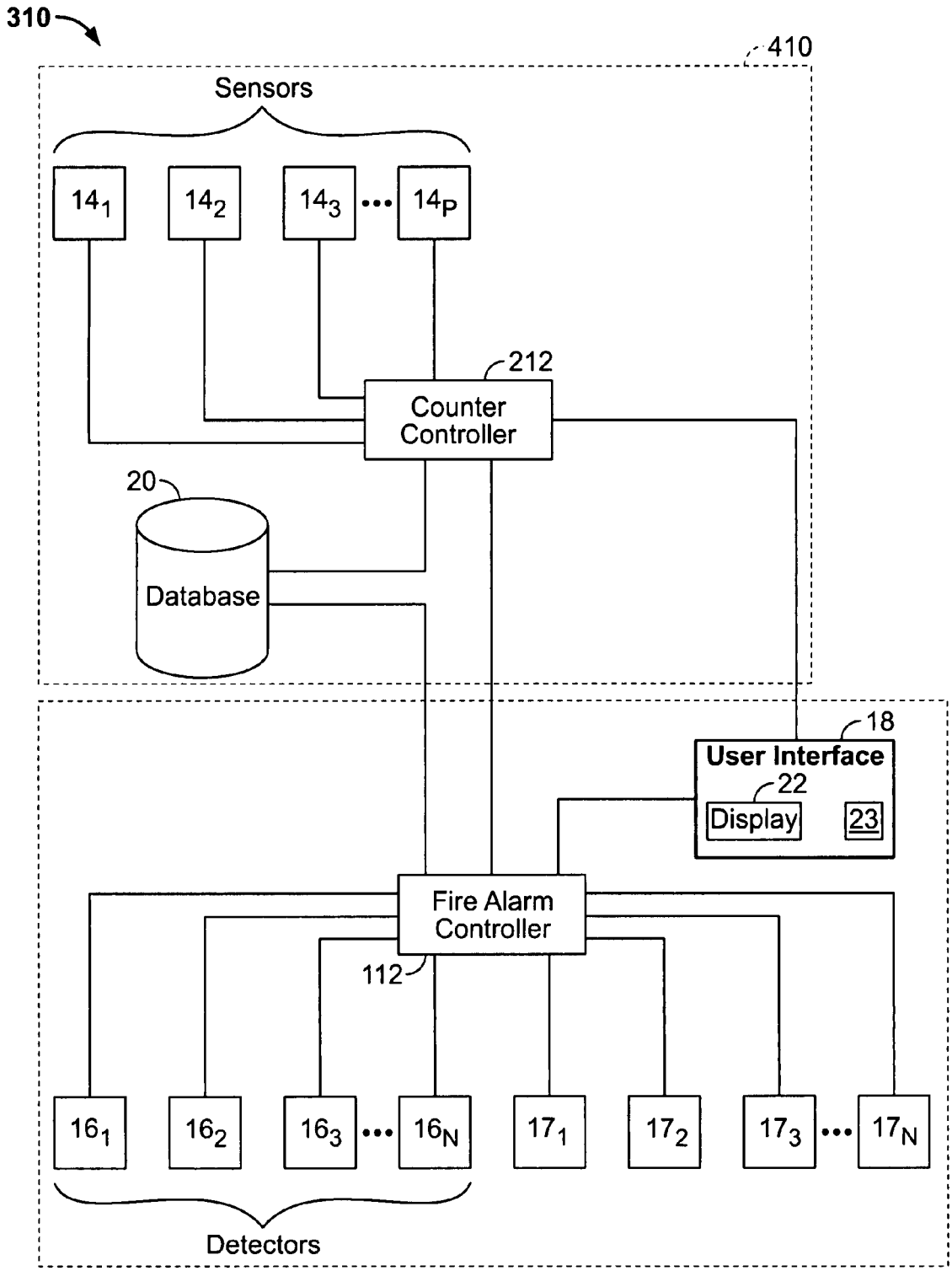
FIG. 3 is a block diagram of an another exemplary alternative embodiment of a fire alarm system.

FIG. 3 is a block diagram of another exemplary alternative embodiment of a fire alarm system 310. The fire alarm system 310 includes the fire alarm controller 112, a plurality of the detectors 16 operatively connected to the fire alarm controller 112, a plurality of the notification appliances 17 operatively connected to the fire alarm controller 112, the user interface 18 operatively connected to the fire alarm controller 112, and a sub-system 410 for monitoring individuals within the premises and for presenting occupancy information of the premises to a user. The sub-system 410 is integrated into the fire alarm system 310 and includes the counter controller 212 operatively connected to the user interface 18, a plurality of the sensors 14 operatively connected to the counter controller 212, and the database 20, which is operatively connected to the fire alarm controller 112 and/or the counter controller 212. The counter controller 212 may optionally be operatively connected to the fire alarm controller 112.

The fire alarm controller 112 receives the emergency events detected by the detectors 16 and the counter controller 212 receives the count information obtained by the sensors 14. The counter controller 212 accesses the database 20 to store the count information in the database 20. In some embodiments, the counter controller 212 also receives the emergency events detected by the detectors 16 from the fire alarm controller 112 and accesses the database 20 to store the detected emergency events in the database 20. Alternatively, the fire alarm controller 112 accesses the database 20 to store the detected emergency events in the database 20.

The counter controller 212 and the fire alarm controller 112 may communicate with each other to achieve the co-display of the count information and the detected emergency event(s). Using the user interface 18, the counter controller 212 may co-display the count information and the detected emergency events for one or more zones, the fire alarm controller 112 may co-display the count information and the detected emergency events for one or more zones, or the counter controller 212 and the fire alarm controller 112 work together to co-display the count information and the detected emergency event(s). Specifically, in some embodiments the counter controller 212 may communicate with the user interface 18 to display the count information and the fire alarm controller 112 may communicate with the user interface 18 to display the detected emergency event(s).

The counter controller 212 and/or the fire alarm controller 112 may co-display the count information and the detected emergency event(s) using count information and/or a detected emergency event(s) received directly from the sensors 14 and the detectors 16, respectively. Alternatively, the counter controller 212 and/or the fire alarm controller 112 may access the database 20 to obtain count information and/or a detected emergency event(s) that is stored on the database 20 for co-display on the user interface 18. Moreover, the counter controller 212 and/or the fire alarm controller 112 may co-display count information and a detected emergency event(s) using a combination of data received directly from the sensors 14 and/or the detectors 16 and data stored on the database 20. The database 20 may store identification of the zone(s) of the premises that each detector 16 and/or each sensor 14 is associated with such that the detected emergency events and the count information co-displayed to the user may be identified with the corresponding zone(s). In addition or alternative, the counter controller 212 and/or the fire alarm controller 112 may receive an identifier directly from the sensor 14 and/or the detector 16 that identifies which zone(s) the sensor 14 and/or the detector 16 is associated with.

Although only one database 20 is shown in FIG. 3, the fire alarm system 310 overall and the sub-system 410 individually may each have any number of databases 20 for storing the count information and the detected emergency events. For example, in addition to the database 20 of the sub-system 410, the fire alarm system 310 may another database 20 that is not part of the sub-system 410 for storing the detected emergency events, wherein the database 20 of the sub-system 210 stores the count information. The database 20 that stores the count information may also store information that identifies which zone each sensor 14 is associated with. Likewise, the database 20 that stores the detected events may also store information that identifies which zone each detector 16 is associated with. Alternatively, the fire alarm system 310 and/or the sub-system 410 may include one or more other databases 20 for storing information that identifies which zone each sensor 14 and each detector 16 is associated with.

Figures 4, 5:
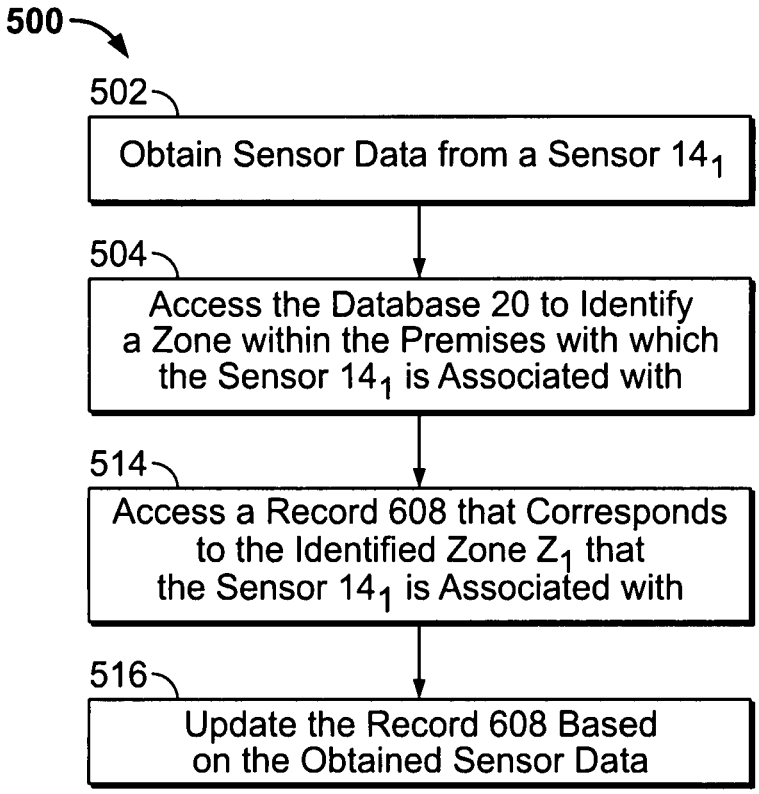
FIG. 4 is a flowchart illustrating an exemplary embodiment of a method for monitoring individuals within the premises.
FIG. 5 is an exemplary embodiment of a counting sensor/zone association table.

FIG. 4 is a flowchart illustrating an exemplary embodiment of a method 500 for monitoring individuals within the premises. The method 500 includes obtaining 502 sensor data from a sensor 14 (FIGS. 1-3), for example the sensor $\mathbf{14}_1$. The sensor data is obtained 502 by the controller 12 or 212 (FIG. 1, and FIGS. 2 and 3, respectively) and includes the count information determined by the sensor $\mathbf{14}_1$. Specifically, the count information determined by the sensor $\mathbf{14}_1$ may include, but is not limited to, a new count of individuals within the zone that the sensor $\mathbf{14}_1$ is associated with, a count of the number of individuals that have entered the zone that the sensor $\mathbf{14}_1$ is associated with since the last count and/or over an amount of time, and/or a count of the number of individuals that have exited the zone that the sensor $\mathbf{14}_1$ is associated with since the last count and/or over an amount of time. The controller 12 or 212 then accesses 504 the database 20 (FIGS. 1-3) to identify a zone within the premises that the sensor $\mathbf{14}_1$ is associated with. For example, the controller 12 or 212 may access 504 a counting sensor/zone association table that is stored within the database 20 to identify the zone that the sensor $\mathbf{14}_1$ is associated with. Although the counting sensor/zone association table may have any format and contain any desired information and/or data, FIG. 5 illustrates an exemplary embodiment of a counting sensor/zone association table 506 that may be stored in the database 20. The counting sensor/zone association table 506 includes a column 508 that lists each of the sensors $\mathbf{14}_{1\text{-}P}$ that are included within and/or adjacent the premises for obtaining count information. The counting sensor/zone association table 506 also includes a column 510 that lists each of the zones $Z_{1\text{-}M}$ of the premises. The counting sensor/zone association table 506 includes a plurality of rows 512 that match each sensor 14 with the zone the sensor 14 is associated with. As can be seen in FIG. 5, in the exemplary embodiment some zones, such as zones $Z_1$, $Z_4$, and $Z_5$, have only one sensor $\mathbf{14}_1$, $\mathbf{14}_7$, and $\mathbf{14}_8$, respectively, associated therewith. Other zones, such as zones $Z_2$ and $Z_3$, have a plurality of sensors $\mathbf{14}_{2\ and\ 3}$ and $\mathbf{14}_{4\text{-}6}$, respectively, associated therewith. However, the sensor/zone associations shown in counting sensor/zone association table 506 are exemplary only. As described above, each zone of the premises may have any number of sensors 14 associated therewith.

Referring again to FIG. 4, once the controller 12 or 212 has identified the zone within the premises that the sensor $\mathbf{14}_1$ is associated with, which in the exemplary embodiment is zone $Z_1$, the controller 12 or 212 accesses 514 a record within the database 20 that corresponds to the identified zone $Z_1$ that the sensor $\mathbf{14}_1$ is associated with. The controller 12 or 212 then updates 516 the corresponding record based on the data obtained by the sensor $\mathbf{14}_1$, including the count information obtained by the sensor $\mathbf{14}_1$. For example, the controller 12 or 212 may access 514 and update 516 a record within an event to individual tracking table stored within the database 20. Although the event to individual tracking table may have any format and contain any desired information and/or data, FIG. 6 is an exemplary embodiment of a screen 601 of the user interface 18 illustrating an exemplary embodiment of an event to individual tracking table 600 that may be stored in the database 20. The event to individual tracking table 600 includes a column 602 that lists each of the zones $Z_{1\text{-}M}$ of the premises. Optionally, the column 602 may include a description of each listed zone $Z_{1\text{-}M}$, as is shown in FIG. 6. The event to individual tracking table 600 also includes a plurality of columns 604 that list a plurality different of emergency events and a plurality of columns that list different count information. The emergency events listed in the columns 604 may be any suitable type of emergency event, such as, but not limited to, emergency events relating to fire (such as, but not limited to, a temperature within the zone the detector 16 is associated with, when a temperature within the zone the detector 16 is associated with is above a dynamic or predetermined threshold, the presence of smoke, water, and/or flame within the zone the detector 16 is associated with, and/or the like), a loss of electrical power within the zone the detector 16 is associated with, the presence of toxic gas within the zone the detector 16 is associated with, activation of a medical emergency alert button and/or a duress button within the zone the detector 16 is associated within, and/or the like. In the exemplary embodiment of FIG. 6, the emergency events listed in the columns 604 are the presence of smoke within the particular zone, the temperature within the particular zone, and the presence of water within the particular zone. Although the count information listed in the columns 606 may be any suitable type of count information obtained by the sensors 14, in the exemplary embodiment the count information includes a current count of the number of individuals within the particular zone, a prior count of the number of individuals within the particular zone, a change indicator indicating whether the number of individuals within the zone has increased or decreased since the prior count, and a count change indicating the number of individuals that have entered or exited the particular zone since the prior count (i.e., the difference between the current count and the prior count).

Referring now to FIGS. 4 and 6, the controller 12 or 212 accesses 514 a record 608 within the event to individual tracking table 600 that corresponds to the zone $Z_1$ with which the sensor $\mathbf{14}_1$ is associated. The controller 12 or 212 then updates 516 the record 608 using the count information obtained by the sensor $\mathbf{14}_1$. For example, in the exemplary embodiment the controller 12 or 212 saves the new count of individuals within the zone $Z_1$ as the current count of individuals within the zone $Z_1$ and saves the preexisting current count as the prior count of individuals within the zone $Z_1$. The controller 12 or 212 also adjusts the change indicator if the previous change indicator is incorrect based on the new count information obtained by the sensor $\mathbf{14}_1$ and also saves the difference between the new current count and the preexisting current count (the new prior count) as the count change. In the exemplary embodiment, the controller 12 or 212 updates 516 the record 608 by saving a current count of 21 individuals within the zone $Z_1$, saving a prior count of 23 individuals within the zone, adjusting the change indicator to indicate that the current count has decreased, and saving the count change as negative two individuals.

Figures 7, 8:
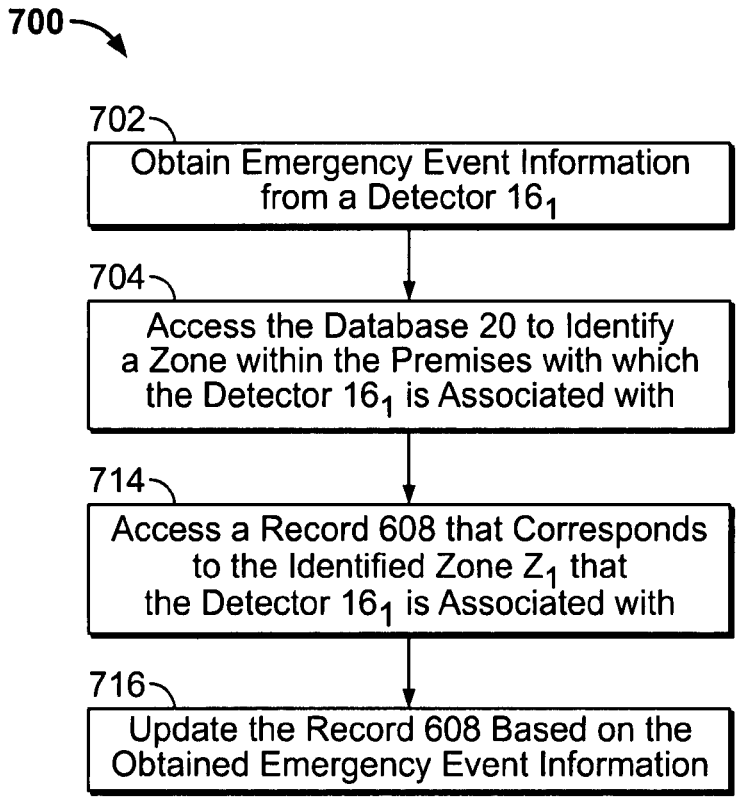
FIG. 7 is a flowchart illustrating an exemplary embodiment of a method for monitoring emergency events within the premises.
FIG. 8 is an exemplary embodiment of an event detection/zone association table.

FIG. 7 is a flowchart illustrating an exemplary embodiment of a method 700 for monitoring emergency events within the premises. The method 700 includes obtaining 702 emergency event data from a detector 16 (FIGS. 1-3), for example the detector $\mathbf{16}_1$. The emergency event data is obtained 702 by the controller 12 or 112 (FIG. 1, and FIGS. 2 and 3, respectively) and includes an emergency event detected by the detector $\mathbf{16}_1$. Specifically, the emergency event data may include any suitable type of emergency event, such as, but not limited to, emergency events relating to fire (such as, but not limited to, the temperature within the zone the detector $\mathbf{16}_1$ is associated with, when a temperature within the zone the detector 16 is associated with is above a dynamic or predetermined threshold, the presence of smoke, water, and/or flame within the zone the detector $\mathbf{16}_1$ is associated with, and/or the like), a loss of electrical power within the zone the detector $\mathbf{16}_1$ is associated with, the presence of toxic gas within the zone the detector $\mathbf{16}_1$ is associated with, activation of a medical emergency alert button and/or a duress button within the zone the detector $\mathbf{16}_1$ is associated within, and/or the like. The controller 12 or 112 then accesses 704 the database 20 (FIGS. 1-3) to identify a zone within the premises that the detector $\mathbf{16}_1$ is associated with. For example, the controller 12 or 112 may access 704 an event detection/zone association table that is stored within the database 20 to identify the zone that the detector $\mathbf{16}_1$ is associated with. Although the event detection/zone association table may have any format and contain any desired information and/or data, FIG. 8 illustrates an exemplary embodiment of an event detection/zone association table 706 that may be stored in the database 20. The event detection/zone association table 706 includes a column 708 that lists each of the detectors $\mathbf{16}_{1\text{-}N}$ that are included within and/or adjacent the premises for detecting emergency events. The event detection/zone association table 706 also includes a column 710 that lists each of the zones $Z_{1\text{-}M}$ of the premises. The event detection/zone association table 706 includes a plurality of rows 712 that match each detector 16 with the zone the detector 16 is associated with. As can be seen in FIG. 8, in the exemplary embodiment some zones, such as zones $Z_1$, $Z_2$, and $Z_4$, have only one detector $\mathbf{16}_1$, $\mathbf{16}_2$, and $\mathbf{16}_5$, respectively, associated therewith. Other zones, such as zones $Z_3$ and $Z_5$, have a plurality of detectors $\mathbf{16}_{3\ and\ 4}$ and $\mathbf{16}_{6\text{-}8}$, respectively, associated therewith. However, the detector/zone associations shown in the event detection/zone association table 706 are exemplary only. As described above, each zone of the premises may have any number of detectors 16 associated therewith.

Referring again to FIG. 7, once the controller 12 or 112 has identified the zone within the premises that the detector $\mathbf{16}_1$ is associated with, which in the exemplary embodiment is zone $Z_1$, the controller 12 or 112 accesses 714 a record within the database 20 that corresponds to the identified zone $Z_1$ that the sensor $\mathbf{14}_1$ is associated with. The controller 12 or 112 then updates 716 the corresponding record based on the emergency event data detected by the detector $\mathbf{16}_1$. For example, the controller 12 or 112 may access 714 and update 716 a record within the event to individual tracking table 600 (FIG. 6) stored within the database 20. Referring now to FIGS. 6 and 7, the controller 12 or 112 accesses 714 the record 608 within the event to individual tracking table 600 that corresponds to the zone $Z_1$ with which the detector $\mathbf{16}_1$ is associated. The controller 12 or 112 then updates 716 the record 608 using the emergency event data obtained by the detector $\mathbf{16}_1$. For example, in the exemplary embodiment the controller 12 or 112 saves an indication that there is a presence of smoke within zone $Z_1$ and saves a temperature of approximately 300° F. present within the zone $Z_1$.

Figure 9:
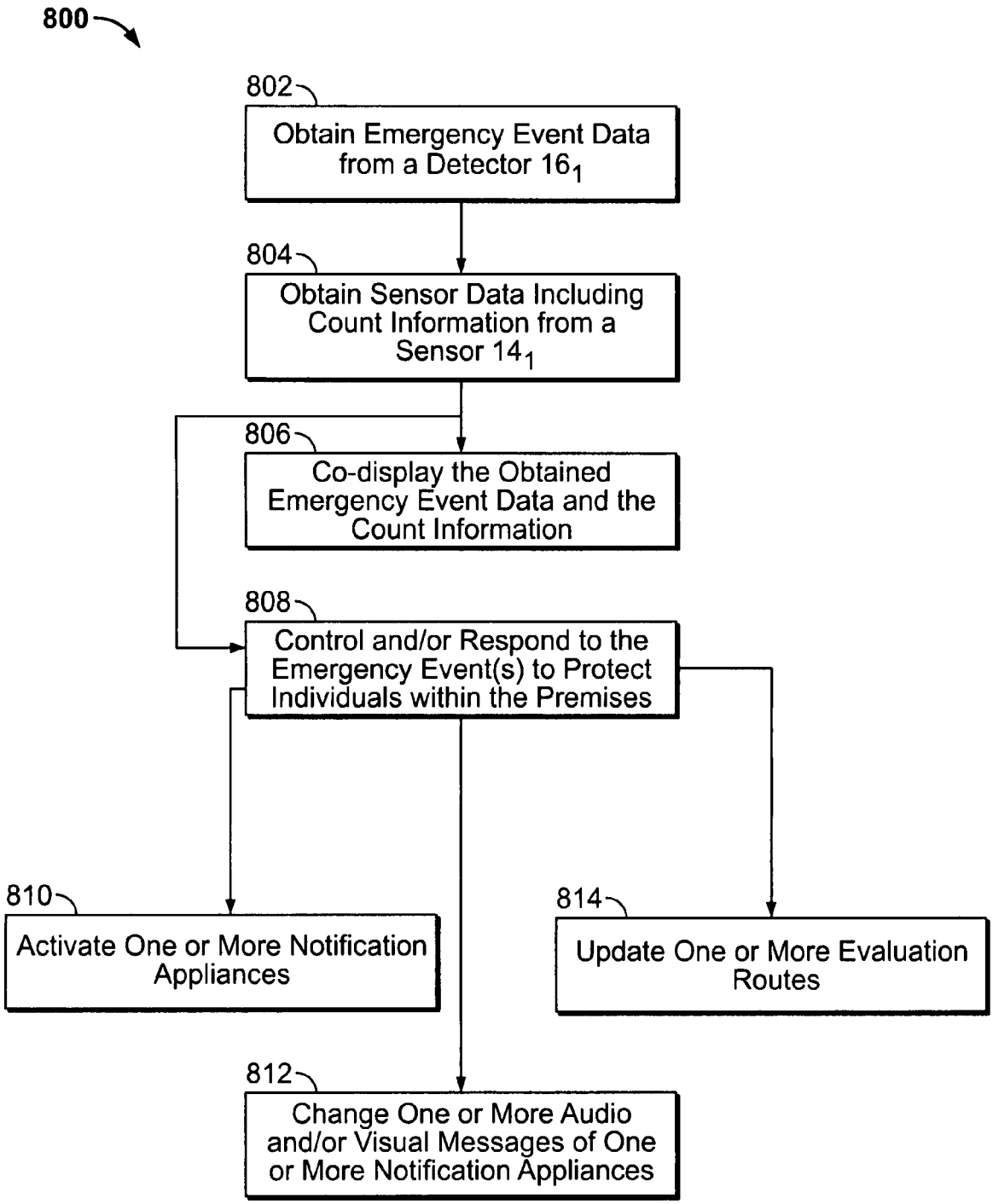
FIG. 9 is a flowchart illustrating an exemplary embodiment of a method for presenting occupancy information in a fire alarm system.

As described above, the systems 10, 110, and 310 may be used to co-display the detected emergency events and the count information. FIG. 9 is a flowchart illustrating an exemplary embodiment of a method 800 for presenting occupancy information in a fire alarm system, such as, but not limited to, the fire alarm systems 10, 110, and 310 (FIGS. 1, 2, and 3, respectively). The method 800 includes obtaining 802 emergency event data from a detector 16 (FIGS. 1-3), for example the detector $\mathbf{16}_1$. The emergency event data is obtained 802 by the controller 12 or 112 (FIG. 1, and FIGS. 2 and 3, respectively) and includes an emergency event detected by the detector $\mathbf{16}_1$. Specifically, the emergency event data may include any suitable type of emergency event, such as, but not limited to, emergency events relating to fire (such as, but not limited to, a temperature within the zone $Z_1$, when a temperature within the zone $Z_1$ is above a dynamic or predetermined threshold, the presence of smoke, water, and/or flame within the zone $Z_1$, and/or the like), a loss of electrical power within the zone $Z_1$, the presence of toxic gas within the zone $Z_1$, activation of a medical emergency alert button and/or a duress button within the zone $Z_1$, and/or the like. In some embodiments, obtaining 802 emergency event data may include obtaining emergency event data for a plurality of zones of the premises. The method also includes obtaining 804 sensor data from a sensor 14 (FIGS. 1-3), for example the sensor $\mathbf{14}_1$. The sensor data is obtained 804 by the controller 12 or 212 (FIG. 1, and FIGS. 2 and 3, respectively) and includes the count information obtained by the sensor $\mathbf{14}_1$. Specifically, the count information obtained by the sensor $\mathbf{14}_1$ may include, but is not limited to, a new count of individuals within the zone $Z_1$, a count of the number of individuals that have entered the zone $Z_1$ since the last count and/or over an amount of time, and/or a count of the number of individuals that have exited the zone $Z_1$ since the last count and/or over an amount of time. In some embodiments, obtaining 804 sensor data may include count information for a plurality of zones of the premises. Moreover, the method 800 may optionally include identifying which zone within the premises that the sensor $\mathbf{14}_1$ and the detector $\mathbf{16}_1$ are associated with, for example as described above with respect to the methods 500 and 700 of FIGS. 4 and 7, respectively.

Once the emergency event data and the count information has been obtained 802 and 804, respectively, the method 800 may optionally include the controller 12, the interface unit 222, the controller 112, or the controller 212 using the user interface 18 to co-display 806 the emergency event data and the count information, as described above. In some embodiments, the emergency event data and the count information are co-displayed simultaneously. Moreover, any portion of the emergency event data and the count information may be co-displayed, and the emergency event data and count information may be co-displayed in any format, such as, but not limited to, textually and/or graphically. For example, in the exemplary embodiment, the event to individual tracking table 600 (FIG. 6) is displayed by the user interface 18 to co-display the emergency event data and the count information. Although as described above the event to individual tracking table 600 may have any format and contain any desired information and/or data, in the exemplary embodiment of FIG. 6 the event to individual tracking table 600 co-displays whether there is a presence of smoke within the zone $Z_1$, a temperature within zone $Z_1$, whether there is a presence of water within zone $Z_1$, a current count of the number of individuals within zone $Z_1$, a prior count of the number of individuals within zone $Z_1$, a change indicator indicating whether the number of individuals within zone $Z_1$ has increased or decreased since the prior count, and a count change indicating the number of individuals that have entered or exited the zone $Z_1$ since the prior count (i.e., the difference between the current count and the prior count). The change indicator may be any suitable symbol or other indication. In the exemplary embodiment, the change indicator is an arrow.

Optionally, in addition or alternative to co-displaying 806, the method 800 may include controlling and/or responding 808 (whether the control and/or response is made by the user and/or by the controller 12, the interface unit 222, the controller 112, or the controller 212) to the emergency event(s) to protect individuals within the premises. For example, controlling and/or responding to the emergency event to protect individuals within the premises may include, but is not limited to, activating 810 one or more of the notification appliances 17 (FIGS. 1-3), changing 812 one or more audio and/or visual messages of one or more of the notification appliances 17, updating 814 one or more evacuation routes from the premises or one or more evacuation routes from one or more zones of the premises to avoid congestion, and/or the like.

Figure 10:
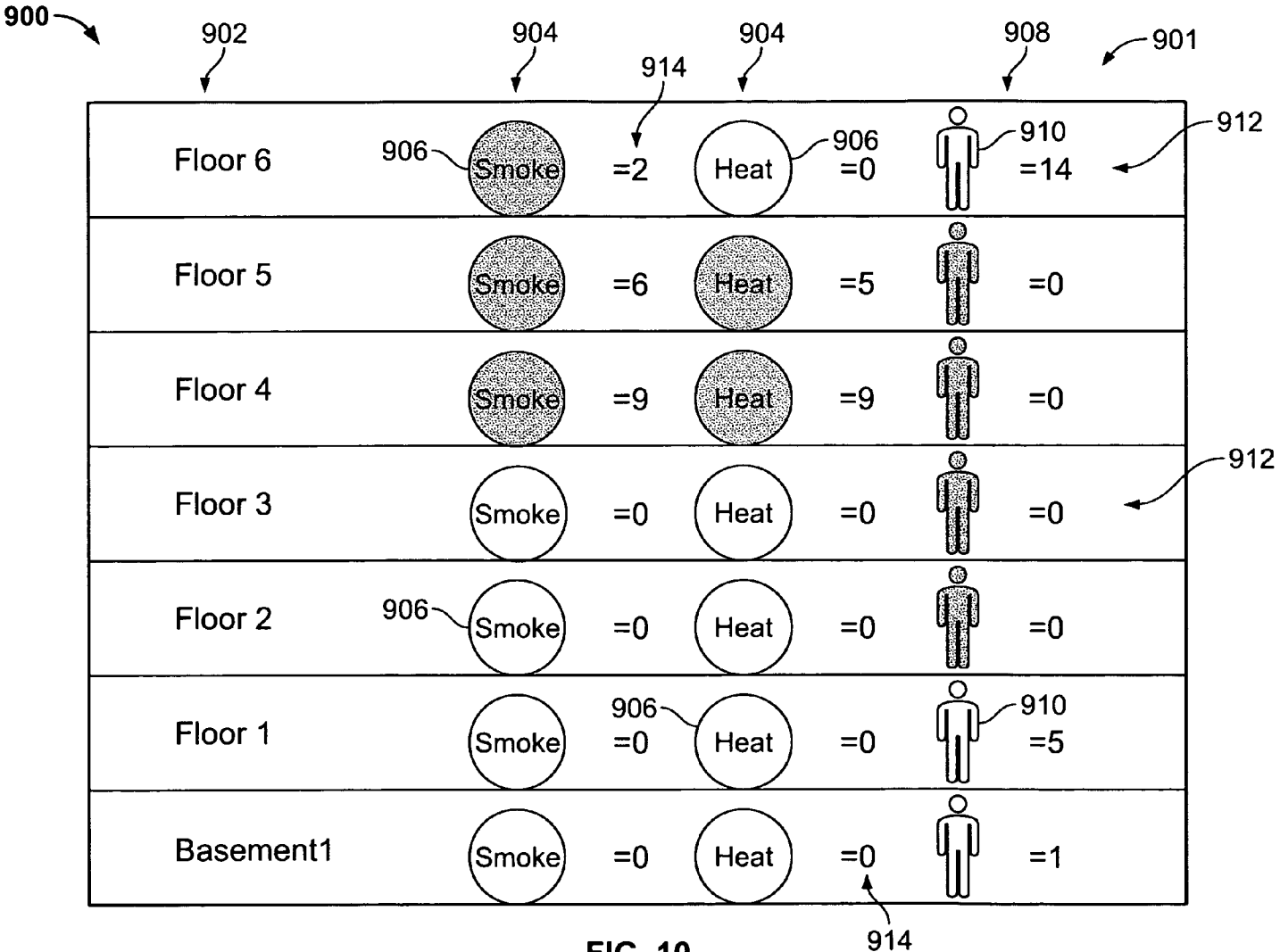
FIG. 10 is an exemplary embodiment of a user interface screen illustrating another exemplary embodiment of an event to individual tracking table.

FIG. 10 is another exemplary embodiment of a screen 901 of the user interface 18 (FIGS. 1-3) illustrating an exemplary embodiment of an event to individual tracking table 900. The event to individual tracking table 900 includes a column 902 that lists each of a plurality of zones of the premises, which in the exemplary embodiment of FIG. 10 includes floors 1-6 and the basement of the premises. The event to individual tracking table 900 also includes a plurality of columns 904 that each includes icons 906 that represent emergency events for each zone of column 902. A column 908 includes icons 910 that indicate individuals and values 912 that represent count information for each zone of column 902. The emergency events icons 906 shown in the columns 904 may each represent any suitable type of emergency event, such as, but not limited to, emergency events relating to fire (such as, but not limited to, a temperature within the particular zone, when a temperature within the particular zone is above a dynamic or predetermined threshold, the presence of smoke, water, and/or flame within the particular zone, and/or the like), a loss of electrical power within the particular zone, the presence of toxic gas within the particular zone, activation of a medical emergency alert button and/or a duress button within the particular zone, and/or the like. In the exemplary embodiment of FIG. 10, the emergency events represented by the icons 906 are the presence of smoke within the particular zone and when a temperature within the particular zone is above a dynamic or predetermined threshold, which is indicated by the phrase "heat". The count information shown in the column 906 may be any suitable type of count information obtained by the sensors 14 (FIGS. 1-3), such as, but not limited to, a current count of a number of individuals within the particular zone, a change of the number of individuals within the particular zone, a number of individuals that have entered and/or exited the particular zone the sensor 14 over an amount of time, and/or the like. In the exemplary embodiment of FIG. 10, the count information shown in column 908 includes the values 912 that each represents a current count of the number of individuals within the particular zone.

Optionally, each emergency event icon 906 includes a value 914 associated therewith that indicates how many detectors 16 (FIGS. 1-3) within the particular zone have detected the emergency event represented by the particular icon 906. Although not shown in FIG. 10, each value 914 may optionally indicate the total number of detectors 16 that are associated with the particular zone (e.g., 2/5, which indicates that 2 detectors have detected the particular emergency event out of 5 detectors total). In addition or alternative to the values 914, the emergency event icons 906 may optionally be highlighted, or de-highlighted, using any color or lack thereof when at least one detector 16 within the zone the icon 906 is associated with has detected the particular emergency event, as shown in FIG. 10. Different colors may optionally be used to indicate different numbers of detectors 16 within the particular zone that have detected the emergency event represented by the particular icon 906. In addition or alternative to the values 912, the icons 910 may also optionally be highlighted, or de-highlighted, using any color or lack thereof when at least one individual is determined to be within the particular zone the icon 910 is associated with, as shown in FIG. 10. Different colors may optionally be used to indicate different numbers of individuals within the particular zone.

Optionally, each emergency event icon 906 may include a value (not shown) associated therewith that indicates a severity of the detected emergency event represented by the particular icon 906. For example, the emergency event icons 906 that indicate the presence of smoke may include a value associated therewith that indicates a level of visual obscuration (such as, but not limited to, per foot) of the smoke that is present and/or the emergency event icons 906 that represent heat may include a value associated therewith that indicates the value of a detected temperature within the particular zone. Each temperature value may optionally indicate a dynamic or predetermined threshold temperature value of which the listed temperature is greater. In addition or alternative to the values indicating the severity, the emergency event icons 906 may optionally be highlighted, or de-highlighted, using any color or lack thereof to indicate the severity. Different colors may optionally be used to indicate different severities (such as, but not limited to, different levels of visual obscuration and/or different temperature values).

Figure 11:
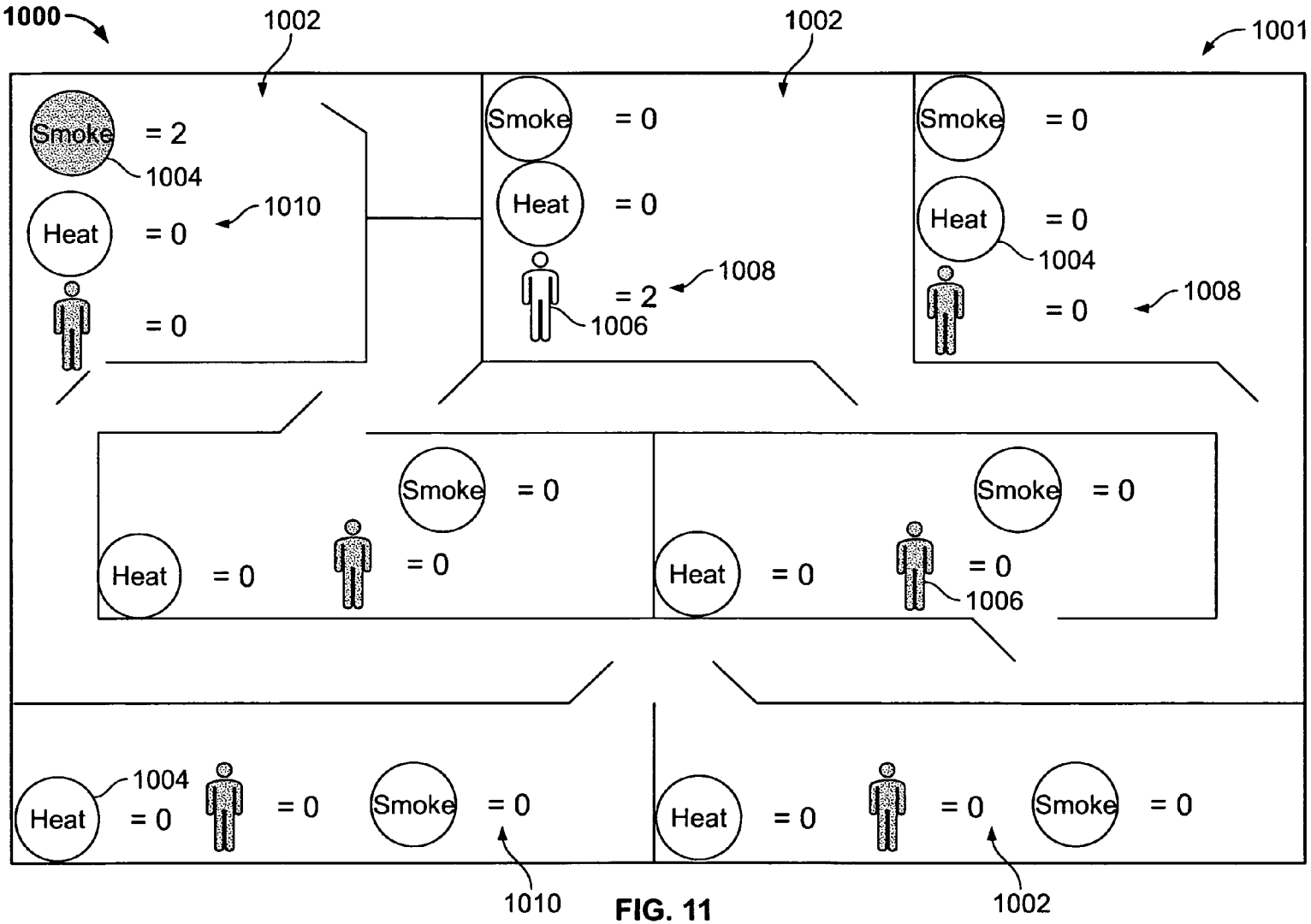
FIG. 11 is an exemplary another embodiment of a user interface screen illustrating yet another exemplary embodiment of an event to individual tracking table.

FIG. 11 is an exemplary embodiment of a screen 1001 of the user interface 18 (FIGS. 1-3) illustrating an exemplary embodiment of an event to individual tracking table 1000. Rather than using a plurality of columns and rows, the event to individual tracking table 1000 displays a layout of the premises that is divided into a plurality of zones 1002 of one floor of the premises. Each displayed zone 1002 has a plurality different of emergency events and count information displayed therein. Specifically, in the exemplary embodiment each zone 1002 includes icons 1004 that represent emergency events and icons 1006 and associated values 1008 that indicate count information. The emergency events icons 1004 may each represent any suitable type of emergency event, such as, but not limited to, emergency events relating to fire (such as, but not limited to, a temperature within the particular zone, when a temperature within the particular zone is above a dynamic or predetermined threshold, the presence of smoke, water, and/or flame within the particular zone, and/or the like), a loss of electrical power within the particular zone, the presence of toxic gas within the particular zone, activation of a medical emergency alert button and/or a duress button within the particular zone, and/or the like. In the exemplary embodiment of FIG. 11, the emergency events represented by the icons 1004 are the presence of smoke within the particular zone and when a temperature within the particular zone is above a dynamic or predetermined threshold, which is indicated by the phrase "heat". The count information shown in each zone 1002 may be any suitable type of count information obtained by the sensors 14 (FIGS. 1-3), such as, but not limited to, a current count of a number of individuals within the particular zone, a change of the number of individuals within the particular zone, a number of individuals that have entered and/or exited the particular zone the sensor 14 over an amount of time, and/or the like. In the exemplary embodiment of FIG. 11, the count information shown in each zone 1002 includes the values 1008 that each represents a current count of the number of individuals within the particular zone.

Optionally, each emergency event icon 1004 includes a value 1010 associated therewith that indicates how many detectors 16 (FIGS. 1-3) within the particular zone have detected the emergency event represented by the particular icon 1010. Although not shown in FIG. 11, each value 1010 may optionally indicate the total number of detectors 16 that are associated with the particular zone (e.g., 2/5, which indicates that 2 detectors have detected the particular emergency event out of 5 detectors total). In addition or alternative to the values 1010, the emergency event icons 1004 may optionally be highlighted, or de-highlighted, using any color or lack thereof when at least one detector 16 within the zone the icon 1004 is associated with has detected the particular emergency event, as shown in FIG. 11. Different colors may optionally be used to indicate different numbers of detectors 16 within the particular zone that have detected the emergency event represented by the particular icon 1004. In addition or alternative to the values 1008, the icons 1006 may also optionally be highlighted, or de-highlighted, using any color or lack thereof when at least one individual is determined to be within the particular zone the icon 1006 is associated with, as shown in FIG. 11. Different colors may optionally be used to indicate different numbers of individuals within the particular zone.

Optionally, each emergency event icon 1004 may include a value (not shown) associated therewith that indicates a severity of the detected emergency event represented by the particular icon 1004. For example, the emergency event icons 1004 that indicate the presence of smoke may include a value associated therewith that indicates a level of visual obscuration (such as, but not limited to, per foot) of the smoke that is present and/or the emergency event icons 1004 that represent heat may include a value associated therewith that indicates the value of a detected temperature within the particular zone. Each temperature value may optionally indicate a dynamic or predetermined threshold temperature value of which the listed temperature is greater. In addition or alternative to the values indicating the severity, the emergency event icons 1004 may optionally be highlighted, or de-highlighted, using any color or lack thereof to indicate the severity. Different colors may optionally be used to indicate different severities (such as, but not limited to, different levels of visual obscuration and/or different temperature values).

Figure 12:
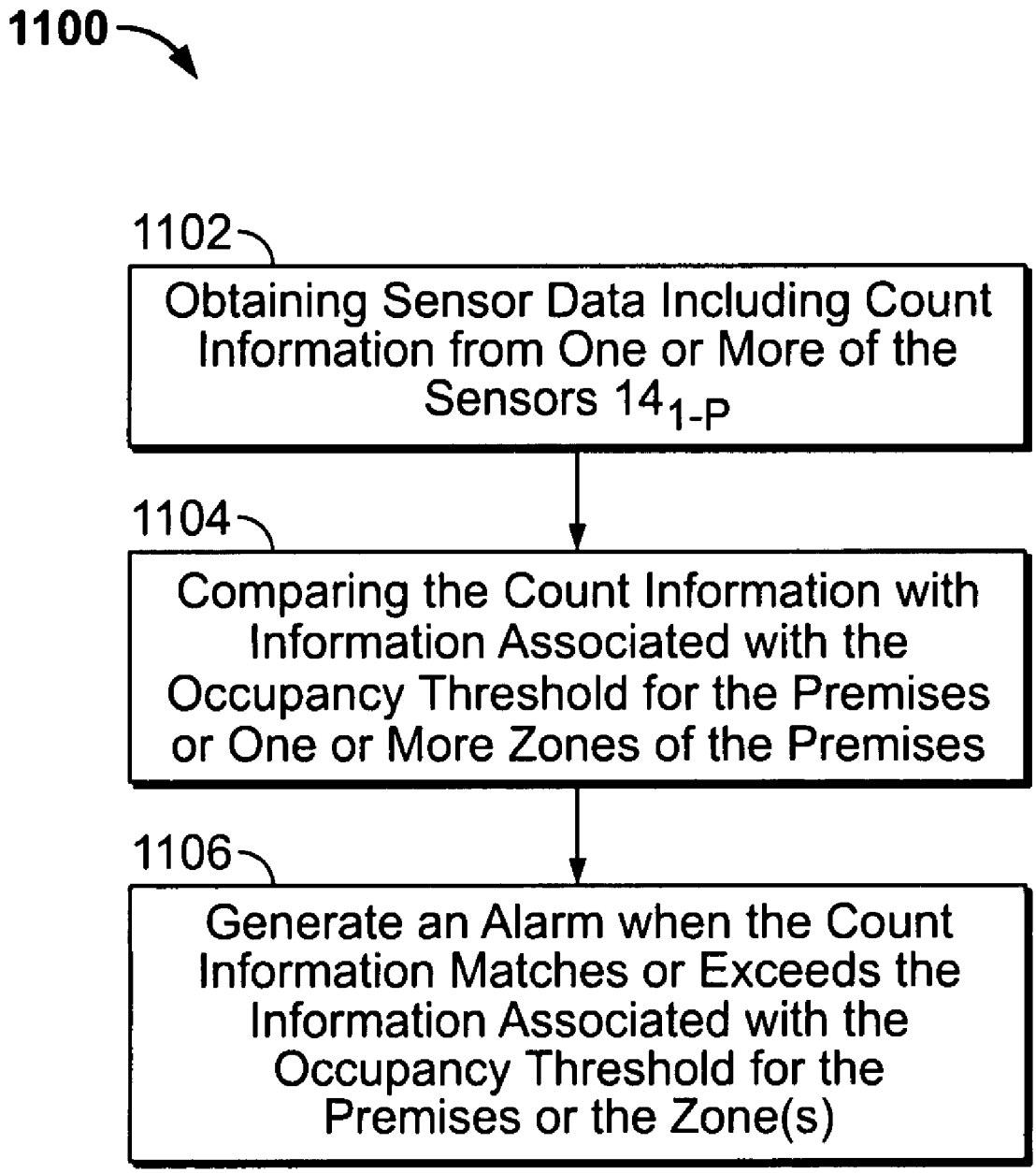
FIG. 12 is a flowchart illustrating an exemplary embodiment of a method for monitoring individuals within a premises with respect to an occupancy threshold for the premises or one or more zones of the premises.

The systems 10, 110, and 310 may also be used to monitor individuals in the premises with respect to an occupancy threshold for the premises or at least one zone of the premises. FIG. 12 is a flowchart illustrating an exemplary embodiment of a method 1100 for monitoring individuals within the premises using a system, such as, but not limited to, the fire alarm systems 10, 110, and 310 (FIGS. 1, 2, and 3, respectively). The method 1100 includes obtaining 1102 sensor data from one or more sensors 14 (FIGS. 1-3), for example, each of the sensors $\mathbf{14}_{1\text{-}P}$, that is associated with a number of individuals within the premises. The sensor data is obtained 1102 by the controller 12 or 212 (FIG. 1, and FIGS. 2 and 3, respectively) and includes count information for one or more of the zones $Z_{1\text{-}M}$ of the premises. Specifically, the count information obtained by the sensors $\mathbf{14}_{1\text{-}P}$ may include, but is not limited to, a count of the number of individuals within the premises or one or more zones of the premises and/or a rate of change of the number of individuals within the premises or the zone(s) of the premises.

Once the sensor data associated with the number of individuals within the premises or the zone(s) of the premises has been obtained 1102, the method 1100 includes comparing 1104, for example using the controller 12 or 212, the count information with information associated with the occupancy threshold for the premises or the zone(s) of the premises. For example, a count of the number of individuals within the premises may be compared with a maximum occupancy limit of individuals within the premises or the zone(s) at one time and/or a threshold limit of individuals within the premises or the zone(s) that is lower than the maximum occupancy limit. Additionally or alternatively, a rate of change of the number of individuals within the premises or the zone(s) may be compared with a threshold rate of change of individuals within the premises or the zone(s). The method 1100 may optionally include generating 1106, for example using the controller 12 or 212 and the user interface 18 (FIGS. 1-3), an alarm when the count information matches or exceeds the information associated with the occupancy threshold for the premises or the zone(s), for example, when the number of individuals within the premises or the zone(s) matches or exceeds the maximum occupancy limit, when the count of the number of individuals within the premises or zone(s) matches or exceeds the threshold limit of individuals within the premises or the zone(s) that is lower than the maximum occupancy limit, and/or when the rate of change of the number of individuals within the premises or the zone(s) matches or exceeds the threshold rate of change of individuals within the premises or the zone(s). The generated 1106 alarm be any suitable type of alarm, such as, but not limited to, an audible alarm and/or a visual alarm.

The threshold limit of individuals within the premises or the zone(s) that is lower than the maximum occupancy limit may be any number of individuals that is below the number of individuals of the maximum occupancy limit, such as, but not limited to, approximately 90% of the maximum occupancy limit. The threshold limit of individuals within the premises or the zone(s) that is lower than the maximum occupancy limit may be predetermined or may be dynamic based on events and/or conditions that may be related to the premises and/or the zone(s), such as, but not limited to, a temperature within and/or adjacent the premises and/or the zone(s), weather within and/or adjacent the premises and/or the zone(s), the operative status and/or ability of systems and/or components of the premises and/or the zone(s) (such as, but not limited to, elevators, escalators, a retractable roof, air conditioning systems, heating systems, and/or the like), and/or the like. Similarly, the threshold rate of change of individuals within the premises or the zone(s) may be predetermined or may be dynamic based on events and/or conditions that may be related to the premises and/or the zone(s), such as, but not limited to, a temperature within and/or adjacent the premises and/or the zone(s), weather within and/or adjacent the premises and/or the zone(s), the operative status and/or ability of systems and/or components of the premises and/or the zone(s) (such as, but not limited to, elevators, escalators, a retractable roof, air conditioning systems, heating systems, and/or the like), and/or the like.

The embodiments described and/or illustrated herein may provide fire departments and/or other emergency response services with information about where individuals are located within a premises during a fire and/or other emergency event. The embodiments described and/or illustrated herein may therefore enable the fire department and/or other emergency response service(s) make decisions on how to control and/or respond to the emergency event and/or to protect individuals within the premises.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

While the invention has been described in terms of various specific embodiments, those skilled in the art will recognize that the invention can be practiced with modification within the spirit and scope of the claims.

What is claimed is:

1. A method for presenting occupancy information in a fire alarm system, said method comprising:

obtaining event data indicative of an emergency event within a zone of a premises;

obtaining count information indicative of a number of individuals within the zone of the premises; and displaying the event data and the count information for the zone simultaneously.

2. The method according to claim 1, wherein obtaining event data comprises determining at least one of a temperature within the zone, when a temperature within the zone is above a threshold, the presence of at least one of smoke, water, and flame within the zone, a loss of electrical power within the zone, the presence of toxic gas within the zone, activation of at least one of a medical emergency alert button and a duress button within the zone.

3. The method according to claim 1, wherein obtaining count information comprises determining at least one of a current count of individuals within the zone, a prior count of individuals within the zone, and a change of the number of individuals within the zone.

4. The method according to claim 1, wherein displaying the event data and the count information comprises displaying an indication of at least one of a temperature within the zone, the presence of at least one of smoke, water, and flame within the zone, a loss of electrical power within the zone, the presence of toxic gas within the zone, activation of at least one of a medical emergency alert button and a duress button within the zone.

5. The method according to claim 1, wherein displaying the event data and the count information comprises displaying an indication of at least one of a current count of individuals within the zone, a prior count of individuals within the zone, and a change of the number of individuals within the zone.

6. The method according to claim 1, wherein displaying the event data and the count information comprises displaying the event data and the count information on the same display.

7. The method according to claim 1, further comprising activating a visual notification appliance to notify the individuals within the zone of the premises about the emergency event.

8. A fire alarm system for a premises, said system comprising:

at least one controller;

a sensor operatively connected to the controller, the sensor configured to sense count information indicative of a number of individuals within a zone of the premises;

a detector operatively connected to the controller, the detector configured to detect event data indicative of an emergency event within the zone of the premises; and a user interface operatively connected to the controller, the user interface configured to display the event data and the count information for the zone simultaneously.

9. The fire alarm system according to claim 8, further comprising a database operatively connected to the controller or operatively connected to an interface unit that is operatively connected to the controller, the database configured to store at least one of the event data and the count information.

10. The fire alarm system according to claim 8, wherein the event data comprises at least one of a temperature within the zone, when a temperature within the zone is above a threshold, the presence of at least one of smoke, water, and flame within the zone, a loss of electrical power within the zone, the presence of toxic gas within the zone, activation of at least one of a medical emergency alert button and a duress button within the zone.

11. The fire alarm system according to claim 8, wherein the count information comprises at least one a current count of individuals within the zone, a prior count of individuals within the zone, and a change of the number of individuals within the zone.

12. The fire alarm system according to claim 8, wherein the user interface is configured to display the event data and the count information on the same display.

13. The fire alarm system according to claim 8, wherein the controller comprises a counter controller and a fire alarm controller, the sensor being operatively connected to the counter controller and the detector being operatively connected to the fire alarm controller.

14. The fire alarm system according to claim 8, wherein the controller comprises a counter controller and a fire alarm controller, the user interface being operatively connected to at least one of the counter controller and the fire alarm controller.

15. The fire alarm system according to claim 8, wherein the controller comprises a counter controller and a fire alarm controller, and the system further comprises an interface unit operatively connected to both of the counter controller and the fire alarm controller.

16. The fire alarm system according to claim 8, further comprising a counter database operatively connected to the controller and an event database operatively connected to the controller, the counter database being configured to store the count information, and the event database being configured to store the event data.

17. The method according to claim 1, further comprising activating an audio notification appliance to notify the individuals within the zone about the emergency event.

18. The method according to claim 1, further comprising activating a visual indicator to notify the individuals about the emergency event, the visual indicator displaying at least one of an evacuation route, a message instructing the individuals to remain within the zone, and a description of the detected emergency event.

19. The method according to claim 1, wherein obtaining count information further comprises obtaining count information using at least one of a finger print scanner, a retina scanner, and a biometric scanner.

20. The method according to claim 1, wherein obtaining count information further comprises utilizing a video image of the zone indicating the emergency event to determine the quantity of individuals within the zone.

21. The method according to claim 1, wherein obtaining count information comprises:

obtaining the count information from a sensor installed at an entrance and a second sensor installed at an egress of the zone; and increasing and decreasing and occupancy count within the zone as people enter and exit the zone using the count information.

* * * * *